US007234995B2

(12) United States Patent
Fildan et al.

(10) Patent No.: US 7,234,995 B2
(45) Date of Patent: Jun. 26, 2007

(54) D-RING FOR BRASSIERES AND THE LIKE

(75) Inventors: Gerhard Fildan, Vienna (AT); Karl Wanzenböck, Leobersdorf (AT)

(73) Assignee: Fildan Accessories Corporation, Humble, TX (US)

( * ) Notice: Subject to any disclaimer, the term of this patent is extended or adjusted under 35 U.S.C. 154(b) by 105 days.

(21) Appl. No.: 11/113,354

(22) Filed: Apr. 22, 2005

(65) Prior Publication Data

US 2006/0252347 A1 Nov. 9, 2006

(51) Int. Cl.

| | |
|---|---|
| ***A41C 3/12*** | (2006.01) |
| ***A41B 17/00*** | (2006.01) |
| ***A41B 11/06*** | (2006.01) |
| ***A41B 11/16*** | (2006.01) |
| *A41C 3/00* | (2006.01) |

(52) U.S. Cl. ..... 450/86; 450/88; 450/1; 24/198; 24/695; 24/265 AL

(58) Field of Classification Search ..... 450/86, 450/88; 2/336, 338, 326–333; 24/198, 598.2, 24/265 AL, 200, 695
See application file for complete search history.

(56) References Cited

U.S. PATENT DOCUMENTS

| | | | | |
|---|---|---|---|---|
| 2,595,139 | A * | 4/1952 | Hart | 450/28 |
| 5,781,970 | A * | 7/1998 | Anscher | 24/573.11 |
| 5,899,791 | A * | 5/1999 | Fildan | 450/82 |
| 5,920,968 | A * | 7/1999 | Anscher | 24/598.2 |
| 5,940,944 | A * | 8/1999 | Anscher | 24/598.2 |
| 6,044,528 | A * | 4/2000 | Schottin | 24/265 AL |

* cited by examiner

*Primary Examiner*—Gloria M. Hale
(74) *Attorney, Agent, or Firm*—Andrew Wilford

(57) ABSTRACT

A D-ring for a shoulder strap assembly and brassiere can have a catch which enables the D-ring to be locked in use or opened for lateral insertion of the loop of the shoulder strap. The catch can be formed by a pin on the bow of the D-ring laterally engageable in an eye of a limb.

20 Claims, 5 Drawing Sheets

D-RING FOR BRASSIERES AND THE LIKE

FIELD OF THE INVENTION

Our present invention relates to a D-ring for brassieres and the like, to a strap connector assembly having such a D-ring, and to a garment comprising shoulder strap assemblies in which such D-rings serve as strap connectors for connecting the shoulder straps to the fabric of the garment, especially a brassiere.

BACKGROUND OF THE INVENTION

To adjust a brassiere or a like garment to the person of the wearer, it is common to provide a pair of shoulder straps which can be adjustable through the use of respective sliders to which a shoulder strap end can be affixed and which can vary the effective length of the shoulder strap.

Commonly the shoulder strap is provided with the slider at the front of the garment and a loop of the shoulder strap passes through a D-ring serving as the strap connector and securing that shoulder strap to the front of the garment. Such shoulder straps are used for lingerie items, for brassieres and in some cases for other garments secured by shoulder straps, e.g. bathing suits.

The D-ring in the past has been connected to the front of the garment by a loop of fabric through, for example, a slit or slot in the ring, by securing the ring to the garment in some other fashion or even by an additional strap arrangement.

The assembly of the garment has posed a problem where a closed D-ring served as the strap connector by complicating the threading of the strap through the D-ring and its slider. The complicated threading technique, of course, lead to increased cost of the garment. Thus the strap connector could be provided with a slot at a side of the passage through which the strap was intended to pass to allow the loop of that strap to be inserted laterally into the connector. While that construction has proved to be effective, the fact that an open slot remained and that the loop could disengage from the connector created difficulties in some cases and has led to a need for improvement.

The ability to insert a strap laterally into the D-ring enables the use of detachable shoulder straps for garments such as brassieres. For example, with the ability to change the shoulder straps of the brassiere, a user can switch between a transparent shoulder strap and woven shoulder strap between shoulder straps of different colors. Normally small hooks are used for connection or detaching of such detachable or replaceable shoulder straps.

OBJECTS OF THE INVENTION

It is, therefore, the principal object of the present invention to provide an improved strap connector or D-ring for connecting a shoulder strap to a garment whereby drawbacks of earlier D-ring arrangements can be obviated.

Another object of the invention is to provide a strap connector which allows the lateral insertion of the strap loop but prevents unwanted withdrawal thereof.

It is also an object of this invention to provide a shoulder strap assembly for garments of the type mentioned heretofore which can facilitate the manufacture of the garment, decrease the manufacturing cost and yet make the shoulder strap assembly more reliable than earlier such assemblies.

It is still a further object of this invention to provide an improved garment having such strap connectors, especially a brassiere or other item of underwear or lingerie.

Yet another object of this invention is to provide an improved D-ring, shoulder strap assembly or garment enabling use of detachable shoulder straps in the sense that this item has been mentioned previously.

It is also an object of this invention to provide a D-ring which can be mounted in an improved manner upon a garment.

SUMMARY OF THE INVENTION

These objects are attained, in accordance with the invention in a shoulder strap to a garment, comprising:

a ring body having a portion connectable to a garment; and a ring formed in one piece with the body, the ring having a limb formed at one end with a first part of a catch and a bow integral with the lower limb at an opposite end of the limb, the bow being formed with a second part of the catch engageable with but separable from the first part, the catch being opened upon separation of the first part from the second part enabling insertion of a loop of a shoulder strap laterally into the ring.

Preferably the strap connector is a D-ring. One of the parts of the catch can be an eye and the other part of the catch can be a pin insertable laterally into the eye. Using the catch arrangement, the lateral opening which is formed by spreading the end of the bow away from the end of the limb, can be securely closed to prevent unwanted withdrawal of the shoulder strap from the D-ring.

The D-ring may be connected to the garment by a sandwich construction, i.e. by providing the D-ring with a generally flat flange or apron which can be sandwiched between two layers of the fabric and can be stitched or, more preferably ultrasonically or thermally welded in place to the two fabric layers on opposite sides of that flange.

The connection of the D-ring to the fabric can, however, be provided by forming the strap connector with a further loop, e.g. another D-ring through which a loop of fabric of the garment can pass.

A shoulder strap assembly according to the invention can thus comprise:

a shoulder strap comprising a slide for adjusting a length of the shoulder strap and a loop at an end of the shoulder strap; and a strap connector for connecting the shoulder strap to a garment and comprising:

a ring body having a portion connectable to the garment, and a ring formed in one piece with the body, the ring having a limb formed at one end with a first part of a catch and a bow integral with the lower limb at an opposite end of the limb, the bow being formed with a second part of the catch engageable with but separable from the first part, the catch being opened upon separation of the first part from the second part enabling insertion of the loop of the shoulder strap laterally into the ring.

The invention also includes a garment such as a brassiere, comprising:

a pair of brassiere cups;

a respective shoulder strap for each brassiere cup, each of said shoulder straps comprising a slide for adjusting a length of the shoulder strap and a loop at an end of the shoulder strap; and a respective strap connector for connecting each the shoulder strap to the respective cup and comprising:

a ring body having a portion connectable to the respective cup, and a ring formed in one piece with the body, the ring having a limb formed at one end with a first part of a catch and a bow integral with the lower limb at an opposite end of the limb, the bow being formed with a second part of the catch engageable with but separable from the first part, the catch being opened upon separation of the first part from the second part enabling insertion of the loop of the respective shoulder strap laterally into the ring.

According to the invention, the strap which can be inserted into or removed from the D-ring through the opening is a detachable shoulder strap enabling replacement of the shoulder strap for the garment. For example, the shoulder straps of a brassiere may be exchanged between a transparent and a woven shoulder strap or shoulder straps of different color may be substituted for one another.

The flange on the D-ring, according to another feature of the invention may have two shield-shaped plates or members sandwiching a layer of the fabric of the garment between them and adapted to be ultrasonically sealed to the fabric. One of the plates or shields can be provided with spikes which can penetrate the fabric or strap and allow one side of the flange to be welded through the fabric to the other side of the flange.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
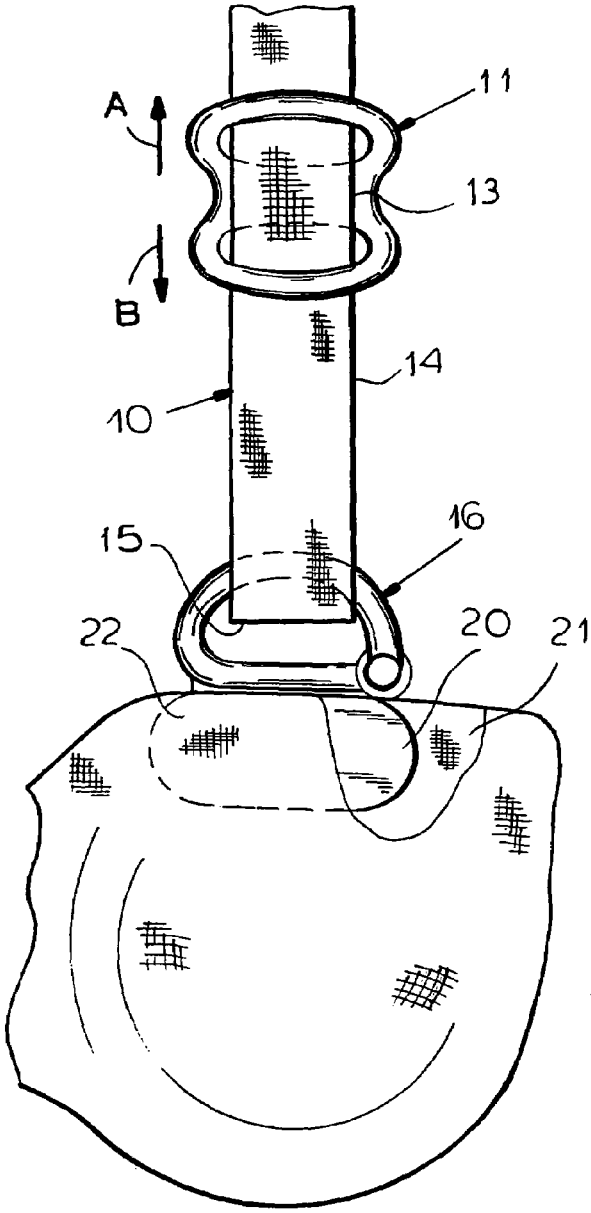
FIG. 1 is a fragmentary elevational view of a brassiere provided with a shoulder strap assembly in accordance with the invention and a D-ring connector.
Figure 2:
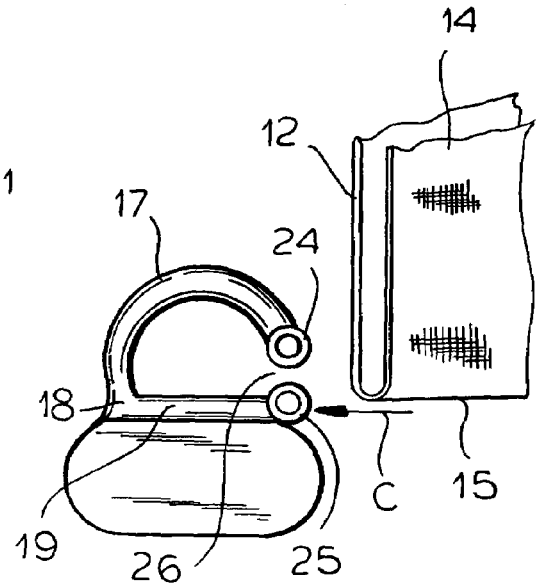
FIG. 2 is a diagram illustrating principles of the invention.

In FIG. 1 we have shown a shoulder strap 10 which passes through a slider 11. The return pass 12 of that shoulder strap can be connected to a central bar 13 of the slider, e.g. by welding, and movement of the slider 11 in the direction A will shorten the effective length of that shoulder strap while movement in the direction of B will increase its effective length. The shoulder strap in the usual manner passes over the shoulder of the wearer to the rear of the garment. Between the front pass 14 of the shoulder strap and the rear pass thereof, a loop 15 is formed (see also FIG. 2) which can be inserted into a D-ring connector 16 in the open position thereof shown in FIG. 2.

Figure 4:
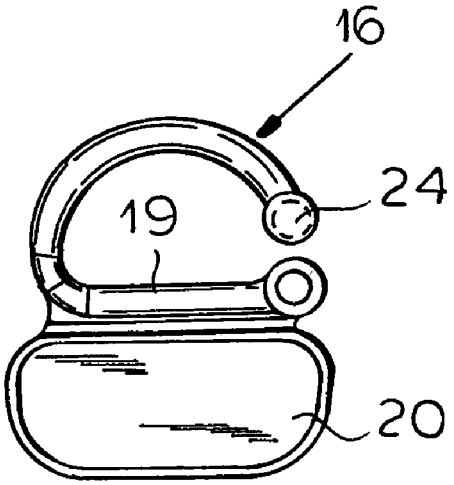
FIG. 4 is a view similar to FIG. 3 showing the D-ring thereof in its open position.
Figure 5:
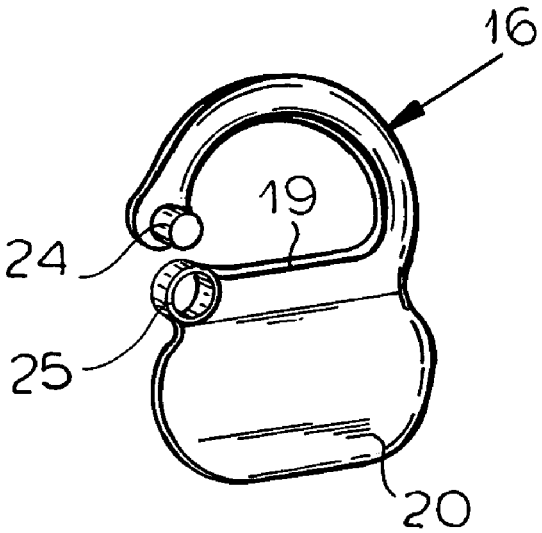
FIG. 5 is a perspective view of the D-ring of FIGS. 3 and 4 in its open position.

The D-ring connector (see also FIGS. 3 to 5) comprises a bow 17 formed in one piece at 18 with a horizontal limb 19 which is formed at the top of a thin flange 20. The connector 16 is injection molded in one piece from a synthetic resin material, e.g. a nylon or another plastic material which can be welded to an underlying fabric layer 21 and to an overlying fabric layer 22 sandwiching the flange 20 between them. Alternatively the fabric and the flange 20 can be stitched through to anchor the D-ring connector 16 to the garment.

The free end 23 is provided with a pin 24 which can be laterally press fitted into a layer 25 to secure the catching formed by the pin and eye in its closed position.

Figure 3:
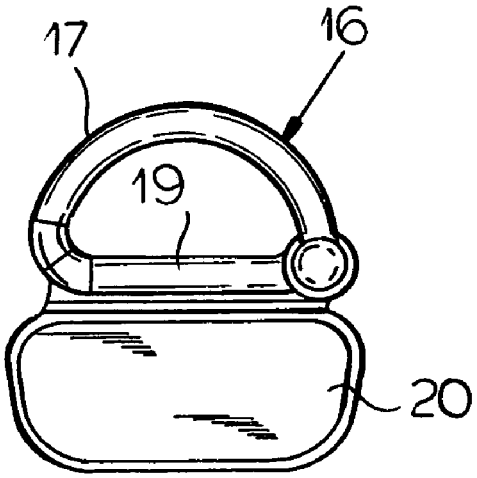
FIG. 3 is an elevational view of the D-ring of FIGS. 1 and 2.

FIGS. 1 and 3 when the pin is pulled out of the eye, the D-ring can be opened (FIGS. 2, 4 and 5) by bending the bow away from the limb 19, thereby forming a gap 26 through which loop 15 can be inserted (arrow C). The catch can be engaged to lock the D-ring closed in use.

Figure 7:
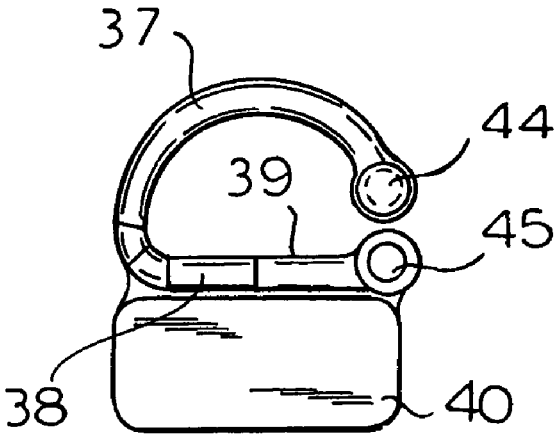
FIG. 7 is a view similar to FIG. 4 of this other embodiment.
Figure 6:
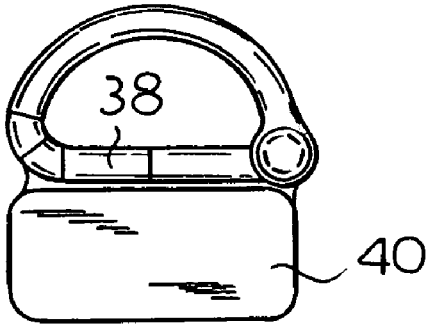
FIG. 6 is a view similar to FIG. 3 showing another embodiment.
Figure 8:
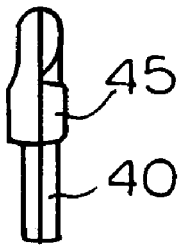
FIG. 8 is a side view of the D-ring for the embodiment of FIGS. 6 and 7.

In the embodiment of FIGS. 6 to 8, the bow 37 is connected to the limb 39 and the catch is formed between the pin 44 and the eye 42. The limb 39 can have an offset 38. The apron or flange in the embodiment of FIGS. 6 to 8 has been represented at 40.

Figure 10:
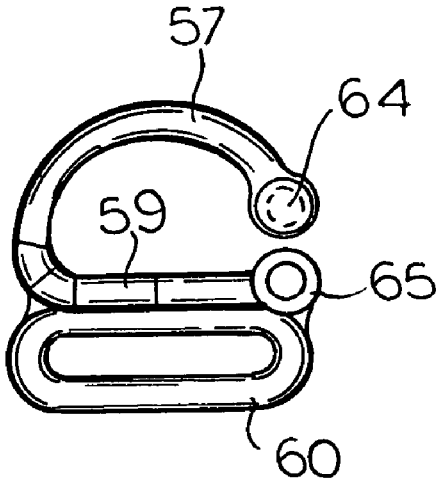
FIG. 10 is an elevational view of the open D-ring of FIG. 9.
Figure 9:
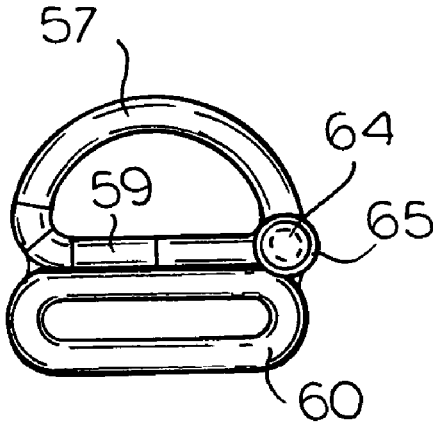
FIG. 9 is a view similar to FIGS. 3 and 6 of a third embodiment.
Figure 11:
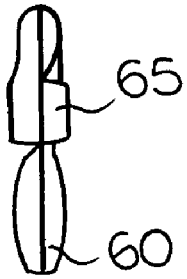
FIG. 11 is a side view of the embodiment of FIGS. 9 and 10.
Figure 13:
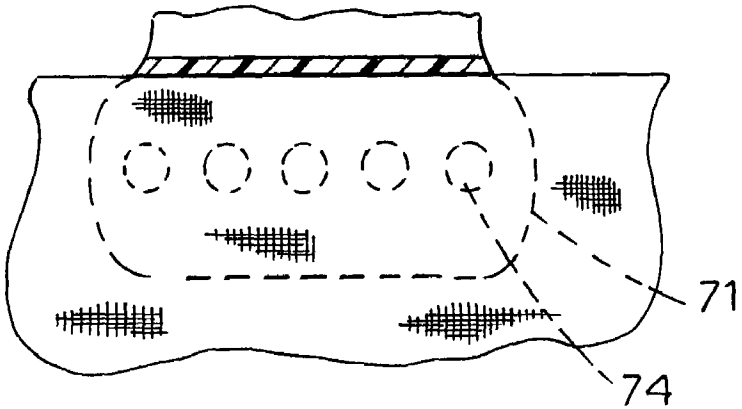
FIG. 13 is a view similar to FIG. 12 showing the fabric between the two flanges, the proximal one of which has been broken away in FIG. 13.

In the embodiment of FIGS. 10 to 11, in place of the apron or flange 40, a loop is provided for the strap and can receive a loop of fabric connected to the garment otherwise the limb 59, the pin 51, the pin 64 and the eye 65 can have the configuration stores in FIGS. 1 and 2 or FIGS. 6 and 7.

Figure 16:
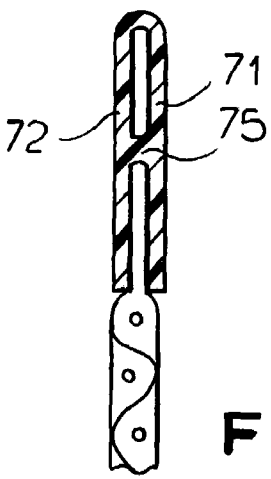
FIG. 16 is a cross sectional view similar to FIG. 15 after the welding.
Figure 15:
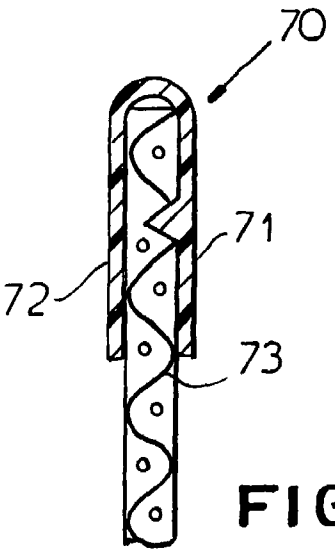
FIG. 15 is a cross sectional view taken along the line XV—XV of FIG. 14 prior to the ultrasonic welding.
Figure 12:
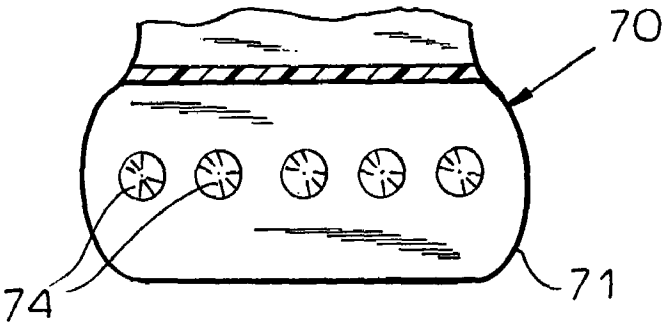
FIG. 12 is an elevational view of one flange of he D-ring in an embodiment in which the fabric is to be sandwiched between two flanges showing the spikes which can pierce through the fabric.
Figure 14:
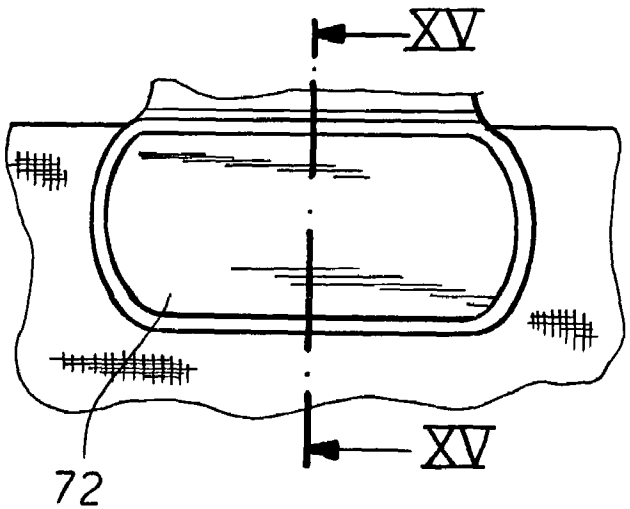
FIG. 14 shows the overlying flange in place.

FIGS. 12–16 show a flange assembly 0 for a D-ring of the type shown in FIGS. 3–8 but wherein two shield-shaped members 71 and 72 sandwich a layer 73 of a fabric or a strap between them. The shield-shaped flange 71 can be formed with a plurality of pointed spikes 74 which, as shown in FIG. 15, penetrate through the fabric 74 and are fused to the flange 72 at 75 as shown in FIG. 16 when the flanges are ultrasonically welded together and to the fabric 73.

The strap 10 (FIG. 1) may be a replaceable strap which is here shown as a fabric or woven strap and can be replaced by a strap of another color or a transparent strap made of a strip of a transparent synthetic resin material.

We claim:

1. In combination with a shoulder strap and a garment, a strap connector comprising:

a body having a portion connectable to the garment; and a ring formed in one piece with said body, said ring having a lower limb formed at one end with a first part of a catch and a bow integral with said lower limb at an opposite end of said lower limb, said bow being formed with a second part of said catch engageable with but separable from said first part, said catch being opened upon separation of said first part from said second part enabling insertion of a loop of the shoulder strap laterally into said ring.

2. The strap connector defined in claim 1 wherein said ring is a D-ring.

3. The strap connector defined in claim 2 wherein one of said parts of said catch is an eye and the other of said parts of said catch is a pin insertable in said eye.

4. The strap connector defined in claim 3 wherein said first part of said catch is said eye and the second part of said catch is said pin and said pin is insertable laterally into said eye.

5. The strap connector defined in claim 4 wherein the garment has two layers of fabric, and said portion connectable to said garment is a flange which can be sandwiched between the two layers of fabric of the garment and secured thereto.

6. The strap connector defined in claim 5 wherein said flange is weldable to the layers of fabric.

7. The strap connector defined in claim 5 wherein said flange is of a thickness enabling it to be stitched through to the layers of fabric.

8. The strap connector defined in claim 4 wherein said portion is another D-ring connected to said garment by a loop of fabric.

9. The strap connector defined in claim 4 wherein said portion connectable to said garment comprises a pair of flanges between which one of the layers of fabric is received and which can be joined to the one layer of fabric by welding.

10. The strap connector defined in claim 9 wherein one of said flanges is provided with at least one spike adapted to pierce the one layer of fabric and weld to the other of said flanges.

11. In combination with a garment, a shoulder strap assembly comprising:

a shoulder strap having an end with a loop;

a slide on the strap for adjusting a length of the shoulder strap; and a strap connector for connecting said shoulder strap to the garment and comprising:

a body having a portion connectable to said garment, and a ring formed in one piece with said body, said ring having a limb formed at one end with a first part of a catch and a bow integral with said lower limb at an opposite end of said limb, said bow being formed with a second part of said catch engageable with but separable from said first part, said catch being opened upon separation of said first part from said second part enabling insertion of said loop of said shoulder strap laterally into said ring.

12. The shoulder strap assembly defined in claim 11 wherein said ring is a D-ring.

13. The shoulder strap assembly defined in claim 12 wherein one of said parts of said catch is an eye and the other of said parts of said catch is a pin insertable in said eye.

14. The shoulder strap assembly defined in claim 13 wherein said first part of said catch is said eye and the second part of said catch is said pin and said pin is insertable laterally into said eye.

15. The shoulder strap assembly defined in claim 14 wherein the garment has two layers of fabric, and said portion connectable to said garment is a flange which can be sandwiched between the two layers of fabric of the garment and secured thereto.

16. The shoulder strap assembly defined in claim 15 wherein said flange is weldable to the layers of fabric.

17. The shoulder strap assembly defined in claim 15 wherein said flange is of a thickness enabling it to be stitched through to the layers of fabric.

18. The shoulder strap assembly defined in claim 14 wherein said portion is another D-ring connected to said garment by a loop of fabric.

19. The shoulder strap assembly defined in claim 11 wherein said shoulder strap is replaceable and forms one of a set of shoulder straps including shoulder straps of different colors or a fabric shoulder strap and a transparent shoulder strap.

20. A brassiere comprising:

a pair of brassiere cups;

a respective shoulder strap for each brassiere cup, each of said shoulder straps comprising a slide for adjusting a length of the shoulder strap and a loop at an end of said shoulder strap; and a respective strap connector for connecting each said shoulder strap to the respective cup and comprising:

a body having a portion connectable to the respective cup, and a ring formed in one piece with said body, said ring having a limb formed at one end with a first part of a catch and a bow integral with said lower limb at an opposite end of said limb, said bow being formed with a second part of said catch engageable with but separable from said first part, said catch being opened upon separation of said first part from said second part enabling insertion of said loop of the respective shoulder strap laterally into said ring.

* * * * *